US011724868B2

(12) United States Patent
Amarello, Jr. et al.

(10) Patent No.: US 11,724,868 B2
(45) Date of Patent: Aug. 15, 2023

(54) PACKAGING SYSTEM FOR GOLF BALLS

(71) Applicant: Acushnet Company, Fairhaven, MA (US)

(72) Inventors: Joseph Amarello, Jr., Acushnet, MA (US); Randy S Amarello, Acushnet, MA (US); Colin W. Veitch, Fairhaven, MA (US); Jedediah H. James, Dighton, MA (US); Michael A. Couto, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 78 days.

(21) Appl. No.: 17/314,095

(22) Filed: May 7, 2021

(65) Prior Publication Data

US 2021/0380323 A1 Dec. 9, 2021

Related U.S. Application Data

(60) Provisional application No. 63/036,490, filed on Jun. 9, 2020.

(51) Int. Cl.
*B65D 81/133* (2006.01)
*B65D 85/58* (2006.01)
*B65D 5/42* (2006.01)

(52) U.S. Cl.
CPC ..... *B65D 81/133* (2013.01); *B65D 5/4204* (2013.01); *B65D 85/58* (2013.01); *B65D 2581/055* (2013.01)

(58) Field of Classification Search
CPC .... B65D 5/4204; B65D 81/133; B65D 85/58; B65D 71/14; A63B 57/20; A63B 47/00
USPC ..... 206/315.9, 776, 783, 782, 565, 521.6, 206/564, 521, 521.1
See application file for complete search history.

(56) References Cited

U.S. PATENT DOCUMENTS 1,840,439 A * 1/1932 Ewell ..... B65D 83/00 206/315.9
3,047,140 A * 7/1962 Robins ..... B65D 71/08 206/820
3,695,479 A * 10/1972 Crabtree ..... B65D 1/36 206/521.1
4,012,530 A * 3/1977 Holden ..... B65D 1/36 206/521.1

(Continued)

FOREIGN PATENT DOCUMENTS

KR 20-0237310 6/2001

*Primary Examiner* — Chun Hoi Cheung
(74) *Attorney, Agent, or Firm* — Thomas P. Gushue

(57) ABSTRACT

A tray for holding golf balls is provided. The tray preferably contains three compartments, and each compartment is sized to hold a single golf ball. The balls are snap-fitted into the compartments and secured in place. The tray containing the balls can be inserted into a small box (sleeve) which then can be loaded into a larger packaging box. The sleeve and window preferably contain transparent windows that are aligned with each other. The outer surface of the balls can be printed with a logo, brand, or other marking that can be seen through transparent windows in the sleeve and packaging box. The packaging system protects the golf balls during shipment as well as providing a creative and attractive way for displaying the golf balls for sale at on-course and off-course facilities.

17 Claims, 8 Drawing Sheets

(56) References Cited

U.S. PATENT DOCUMENTS 4,972,948 A * 11/1990 Saiki ..... B65D 71/14 206/315.9
5,044,495 A * 9/1991 Wyslotsky ..... B65D 81/2061 206/315.9
5,875,891 A 3/1999 Snell
6,012,269 A 1/2000 Vitti
6,193,120 B1 * 2/2001 Chang ..... A63B 57/20 206/315.9
D478,808 S 8/2003 Dubiel et al.
D482,610 S 11/2003 Molitor et al.
6,716,112 B2 4/2004 Rennecamp
6,743,490 B2 6/2004 Fushihara et al.
8,388,091 B2 * 3/2013 Matsui ..... A63B 45/02 347/106
8,727,115 B2 * 5/2014 Liao ..... A63B 57/20 206/315.9
8,770,401 B2 * 7/2014 Fitchett ..... B65D 5/5019 229/162.1
9,415,278 B2 * 8/2016 Kabeshita ..... A63B 47/00
2001/0032794 A1 10/2001 Fushihara et al.
2003/0121809 A1 * 7/2003 Gourd ..... B65D 71/22 206/315.9
2003/0168363 A1 * 9/2003 Molitor ..... B65B 11/22 206/315.9
2005/0148409 A1 7/2005 Morgan et al.
2006/0021888 A1 2/2006 Andre et al.
2006/0060489 A1 * 3/2006 Ohira ..... B65D 5/4233 206/315.9
2007/0241027 A1 * 10/2007 Yang ..... B65D 5/4204 206/580
2009/0277940 A1 * 11/2009 Cook ..... A63B 57/20 206/315.9
2011/0168588 A1 7/2011 Guier
2012/0061272 A1 * 3/2012 Wagner ..... B65D 5/4208 206/320
2012/0152775 A1 6/2012 Hogge et al.
2015/0101946 A1 * 4/2015 Koffler ..... A63B 47/00 206/315.9

* cited by examiner

PACKAGING SYSTEM FOR GOLF BALLS

CROSS-REFERENCE TO RELATED APPLICATIONS

This application claims the benefit of U.S. Provisional Application No. 63/036,490, filed Jun. 9, 2020, the entire disclosure of which is incorporated by reference.

BACKGROUND OF THE INVENTION

Field of the Invention

The present invention relates generally to a packaging system for golf balls. The system includes a specially designed tray for holding the golf balls. The tray can be inserted into a small box (sleeve) which then can be loaded into a larger packaging box. The outer surface of the balls can be printed with a logo, brand, or other marking and these markings can be seen through transparent windows in the sleeve and packaging box.

Brief Review of the Related Art

Multi-piece, solid golf balls having a solid inner core protected by a cover are used today by recreational and professional golfers. The golf balls may have single-layered or multi-layered cores. Normally, the core layers are made of a highly resilient natural or synthetic rubber such as styrene butadiene, polybutadiene, polyisoprene, or a thermoplastic such as ethylene acid copolymer ionomers. The covers may be single or multi-layered and are made of a durable material such as ethylene acid copolymer ionomers or polyurethanes. Also, there may be intermediate (casing) layers disposed between the core and cover. Today, many golf balls generally fall into one of the following categories: a) polyurethane cover; or b) ionomer cover. The majority of ball have at least three (3) layers (pieces). There are some ionomer cover balls having a two-piece construction. Normally, manufacturer prints a standard numeral such as: 1, 2, 3, or 4 on the outer surface of the ball and this numeral marking makes it easier for golfers to identify their ball during play. Some golfers also personally mark their balls to further distinguish their balls from the balls played by other players on the course. This personal marking helps prevent the golfers from playing the wrong ball. These markings also work as an alignment tool for the golfer when making a shot, particularly when putting. Such marking systems are described in the patent literature.

For example, Koffler, U.S. Patent Application Publication US 2015/0101946 discloses a package for golf balls having a rectangular shape with sidewalls containing openings. Each opening is formed at a location that corresponds to a portion of a golf ball, so as to allow each golf ball to be marked individually from the outside of the package. Stencils can be used. The golfer accesses the surface of the ball through the opening in the sidewall and then can mark the ball with a pen.

Cook, U.S. Patent Application Publication US 2009/0277940 discloses a golf ball carrier having coaxially aligned openings for receiving opposing hemispheres of each golf ball. Each corresponding pole of the golf ball can be marked in the carrier. The golf ball functions as a wedge spreading apart the carrier as it is inserted and removed from the carrier.

Rennecamp, U.S. Pat. No. 6,716,112 discloses a golf ball marking guide comprising a shell having a curved inner surface for receiving a golf ball. The guide has peripheral guide edges which facilitate simple marking of perpendicular lines, equatorial lines, and non-equatorial lines on the ball.

Manufacturers of golf balls are constantly looking at different ball materials and constructions to impart specific properties such as, for example, distance, spin, feel, and durability, to the balls. There are significant economic costs to this work of researching, developing, and manufacturing golf balls. The golf balls manufacturers also spend a substantial amount of dollars and resources in advertising, marketing, and selling golf balls.

Typically, golf ball manufacturers package the golf balls in packages, commonly known as a "sleeves." The sleeve is an elongated box normally made of a paper or cardboard material and typically holds three golf balls. The sleeves are then loaded in a larger box. Typically, the larger packaging box is designed to hold two sleeves (a half-dozen box of golf balls) or four sleeves (a dozen box of golf balls).

These boxes of golf balls are then shipped to a retail operation for sale. Some retail facilities are referred to "on-course" shops such as golf shops located at public, private, and resort golf courses. Other retail facilities are referred to as "off-course" shops such as retails stores located in shopping malls. The golf ball manufacturers and professionals in these facilities display the golf balls in a way to best attract and persuade customers to purchase the balls. Different advertising and merchandising tools are used. Golf ball manufacturers are particularly interested in displaying their products with creative packaging and other means so their brand is clearly visible and made attractive to customers. In this way, the manufacturer can leverage itself as the source of the products and build-up brand loyalty.

In recent years, golf ball manufacturers have expanded their development and marketing of customized golf balls for many different customers. For example, many business organizations such as corporations, non-profit entities, schools, professional sport teams, and others want to purchase golf balls that are customized with their personal brand, brandname, trademark, tradename, logo, graphic design, and the like. Also, many individual golfers like to personally customize their golf balls with a special name, symbol, initials, letters, numbers, geometric shapes, and the like. These golfers are interested in aesthetically-pleasing packages to show-off their customized golf balls. These golf ball packages can be attractively displayed in clubhouses, offices, homes, and other places.

Although there are several golf ball packaging systems known in the art as described above, there is a need for an improved packaging system. The packaging assembly should protect the golf balls during shipment as well as providing a creative and attractive way for displaying the golf balls for sale at on-course and off-course facilities. The packaging assembly should also have a unique and aesthetic appearance for consumers. The present invention provides such a packaging system having these features as well as other advantageous benefits.

SUMMARY OF THE INVENTION

The present invention provides a golf ball tray having recessed pockets (cavities) for holding the balls and packaging assemblies for the trays. The tray preferably contains three compartments, and each compartment is sized to hold a single golf ball. The balls are snap-fitted into the compartments and secured in place. The tray can be inserted into a small box (sleeve) which then can be loaded into a larger packaging box. The outer surface of the balls can be printed with a logo, brand, or other marking and these markings can be seen through transparent windows in the sleeve and packaging box.

In one embodiment, the tray comprises: a) an elongated body member comprising a sidewall A having at least three notches and an opposing sidewall B having at least three notches, the body member having a base portion containing at least three recessed cavities; b) a first end wall E and a second end wall F, the end walls being joined to the side walls A and B, wherein each end wall has a notch; c) a first transverse wall C and a second transverse wall D, the transverse walls extending from sidewall A to second sidewall B, wherein each transverse wall has a notch; s that a first ball compartment is defined by the first cavity and a first notch in sidewall A, a first notch in sidewall B, a notch in end wall E, and a notch in transverse wall C; d) a second ball compartment is defined by the second cavity and a second notch in sidewall A, a second notch in sidewall B, a notch in end wall E, the notch in transverse wall C, and a notch in transverse wall D; and e) a third ball compartment is defined by the third cavity and a third notch in sidewall A, a third notch in sidewall B, a notch in end wall F, and the notch in transverse wall D.

The tray can be made from various materials, particularly plastics such as polyester. In one preferred embodiment, each sidewall of the tray has a length of about 3 to about 6 inches, and each end wall has a length of about 1 to about 2 inches, and each ball compartment has a width in the range of about 1 to about 2 inches. In a three-ball tray, the compartments can have the following relationship: width of first ball compartment>width of second ball compartment< width of third ball compartment. Preferably, the width of the first ball compartment is substantially equal to the third ball compartment; and the compartments have an arcuate inner surface. Each compartment preferably has four arm segments, and preferably with chamfered edges, surrounding the recessed cavity for holding the balls in place. After the balls have been loaded into the compartments, the base portion of the tray preferably has a curved structure.

The golf ball trays of this invention can be loaded into packages (sleeves). In one embodiment, the sleeve package comprises a first elongated body member having a first end and an opposing second end and four side walls extending from the first end to the second end, wherein the elongated body member defines a hollow interior region having a square cross-sectional shape for receiving the golf ball tray. Preferably, the first elongated body member is made of cardboard and has at least one transparent window so that at least one golf ball in the tray is visible. The present invention provides a packaging assembly comprising the ball tray and sleeve package.

In one embodiment, the first and second elongated body members of the packaging assembly have multiple transparent windows, the windows being registered with each other so that multiple golf balls in the tray are visible. Preferably, the transparent windows have circular or square shapes.

The packaging assemblies containing the golf ball trays of this invention can be placed in larger packages. In one embodiment, a packaging assembly comprising: a) a first elongated body member having four sidewalls, the sidewalls being joined to each and defining an interior chamber, the chamber being covered by a removable lid so that the chamber can be exposed by removing the lid and covered by closing the lid; b) second elongated body member having a first end and an opposing second end and four side walls extending from the first end to the second end, the elongated body member defining a hollow interior region having a square cross-sectional shape for receiving a golf ball tray containing golf balls. In one embodiment, the first and second elongated body members each have at least one transparent window so that the transparent window of the first elongated body registers with the transparent window of the second elongated body so that at least one golf ball in the tray is visible; and c) the golf ball tray. Preferably, the first and second elongated body members of the packaging assembly are made of cardboard and have multiple transparent windows, the windows being registered with each other so that multiple golf balls in the tray are visible. Preferably, the transparent windows have circular or square shapes.

The golf ball packaging assemblies and trays of this invention have many advantageous features. For example, the golf balls can be inserted and locked into place in the compartments of the trays. The snap-in features of the tray help hold the balls in place and restrict rotation and displacement of the balls during shipping and handling.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION OF THE INVENTION

Golf balls today are produced in a wide variety of colors, such as, for example, white, yellow, orange, green, red, and pink, and are typically colored by painting the outer surface of the ball, or by incorporating pigment directly into the cover composition as discussed above. Normally, the ball also is printed with some type of indicia such as a brand, brandname, trademark, tradename, logo, symbol, shape, graphic design, name, initials, letters, numbers, and the like.

For the mass-production of balls, a standard identifying mark is printed on the ball, and the ink can be applied directly onto the cover or a primer coat. For example, a colored or transparent primer paint can be applied first to the surface of the ball and then ink can be applied over the primer to form the indicia, and then a clear top-coat layer can be applied over the indicia. This transparent topcoat layer protects the printed indicia, provides high gloss, provide abrasion or wear-resistance, and generally enhances the overall aesthetics of the ball. Different printing techniques may be used including, for example, using pad-printing, ink-jet printing, dye-sublimation, and the like. The primer and topcoats can be clear or colored. For custom balls that are marked with a custom logo, the ink is often applied to the topcoat of the finished balls. Therefore, an ink that cures rapidly to prevent the smearing and transfer of the ink to other custom balls or to ball printing and handling equipment is required. As discussed above, golf ball manufacturers spend a substantial amount of dollars and resources in advertising, marketing, and selling golf balls; and protecting and custom golf balls printed with a special marking are very desirable. By the term, "marking" as used herein, it is meant any type of indicia such as a brand, brandname, trademark, tradename, logo, symbol, shape, graphic design, name, initials, letters, numbers, and the like.

Figure 1:
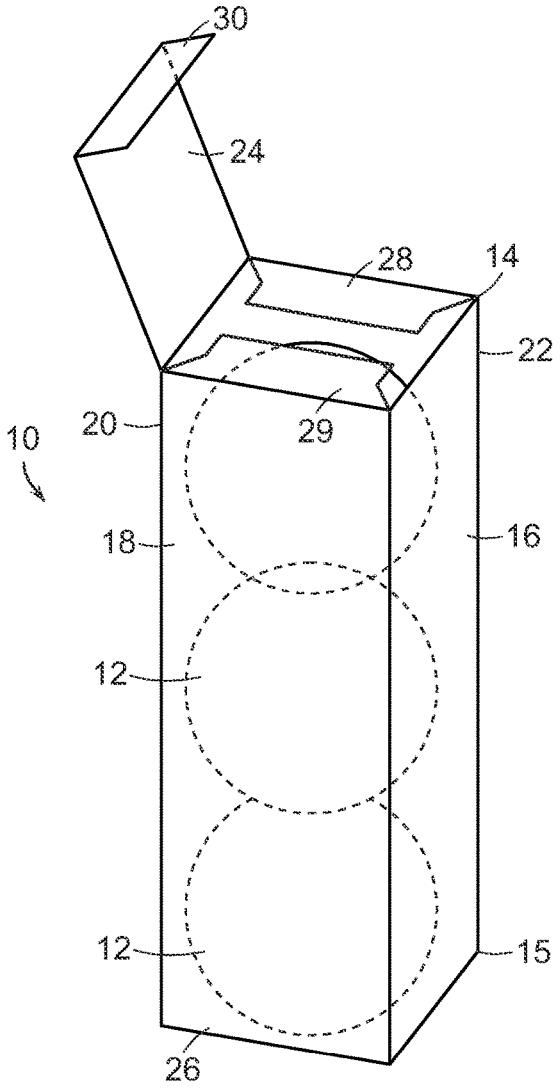
FIG. 1 (PRIOR ART)
FIG. 1 is a perspective view of a golf ball package of the prior art.

Referring to the Figures, where like reference numerals are used to designate like elements, FIG. 1 shows a conventional golf ball package, commonly known as a "sleeve." The sleeve (10) is normally made of a paper or cardboard material and typically holds three (3) golf balls (12). In general, the sleeve (10) is an elongated box having a first end (14) and an opposing second end (15). There are four side walls (16, 18, 20, and 22) extending from the first end (14) to the second end (16). Each of the side walls (16, 18, 20, and 22) has the same length and width and the side walls are joined to each other to form a box having a rectangular shape.

The side walls (16, 18, 20, and 22) define a hollow interior region having a square cross-sectional shape for packing the golf balls (12). The balls (12) are stacked together in the interior region—one on top of the other. The sleeve (10) also includes a first end panel (24) and an opposing second end panel (26) that can be opened and closed. The first end panel (24) is opened so the golf balls (12) can be loaded into the sleeve (10), and then the end panel (24) is closed to securely hold the balls (12) in the sleeve (10). Each end panel (24, 26) can be in the form of an end flap that is connected to one of the side walls (16, 18, 20, and 22) so that it can be opened and closed in a hinge-like manner. The first and second ends (14, 15) also can include tabs (28, 29) that fold-over and extend from the side walls (16, 18, 20, and 22). The end panels (24, 26) also can include a projecting tab (30) that folds-over so that when the end panel is closed, the tab (30) fits between the side wall tabs (28, 29) and rests against one of the side walls to "lock" the sleeve (10).

Figure 1A:
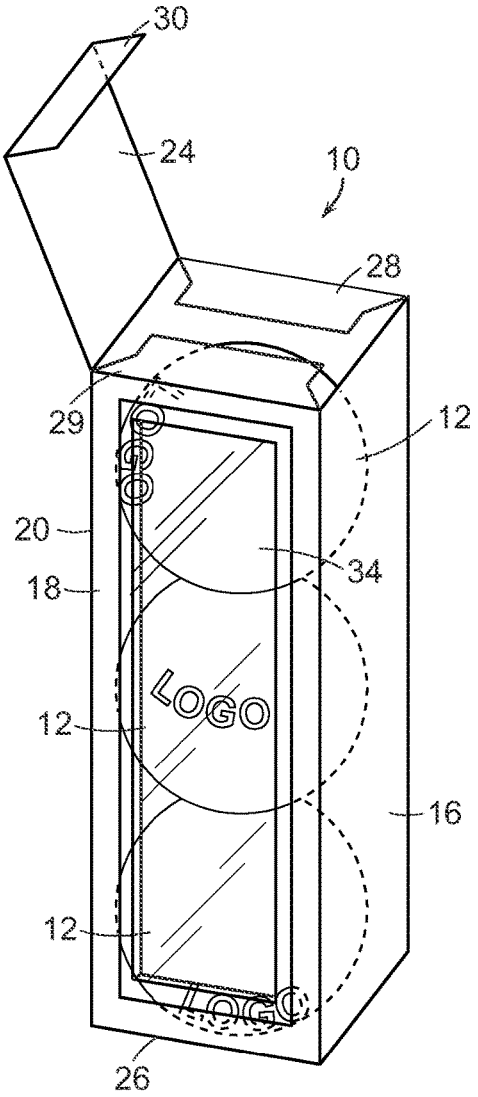
FIG. 1A (PRIOR ART)
FIG. 1A is a perspective view of the prior art golf ball package shown in FIG. 1 showing the balls through a transparent window on the side of the package.

Referring to FIG. 1A, one or more windows (34) are normally formed in at least one of the side walls (16, 18, 20, and 22) so that the ball is visible to a person looking at the sleeve. The window (34) is a cut-out opening in the sidewall and is normally covered by a piece of transparent film. For example, polypropylene, polyethylene, polyester, polyamide, and polyvinyl chloride films can be used. Fushihara et al., U.S. Pat. No. 6,743,490 discloses a window for a golf ball packaging box made of a polylactic film. The window (34) in the packaging sleeve of this invention can have a wide variety of shapes including, for example, circular, oval, triangular, rectangular, square, star, diamond, pyramid, arrow, conical, pentagonal, hexagonal, heptagonal, and octagonal, and the like structures. The portion of the ball (12) which is visible to a person looking at the sleeve (10) is that portion which rests against the transparent window (34). Thus, as shown in FIG. 1A, only a portion of the ball (12) is visible through the transparent window (34). As discussed above, the balls (12) are printed with some type of indicia such as a brand, brandname, trademark, tradename, logo, symbol, shape, graphic design, name, initials, letters, numbers, and the like (hereinafter, collectively referred to as "logo"). The portion of the ball (12) that is visible through the window may or may not contain the logo.

The golf balls (12) are normally machine-loaded into the sleeve (10), and the positioning of the balls (12) is random. The golf balls (12) normally are not pre-loaded in a tray or other carrier structure; rather, they are just dropped directly into the sleeve box (10). As shown in FIG. 1A, the golf balls (12) have been loaded directly into the sleeve (10) and the logo is visible on some balls (12), partially obscured on others, and completely obscured on still others.

Figure 2:
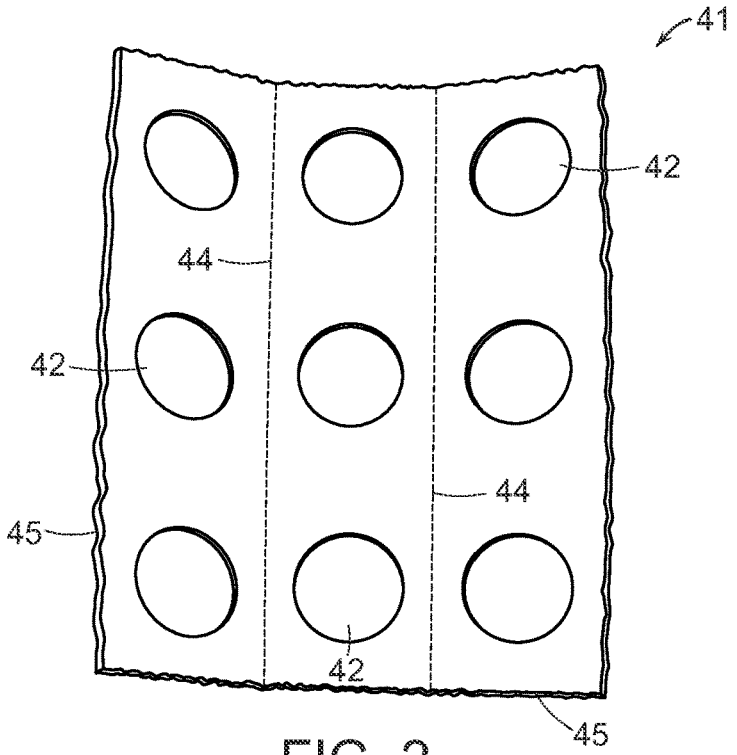
FIG. 2 (PRIOR ART)
FIG. 2 is a top view of a foam tray of the prior art for holding golf balls.
Figure 2A:
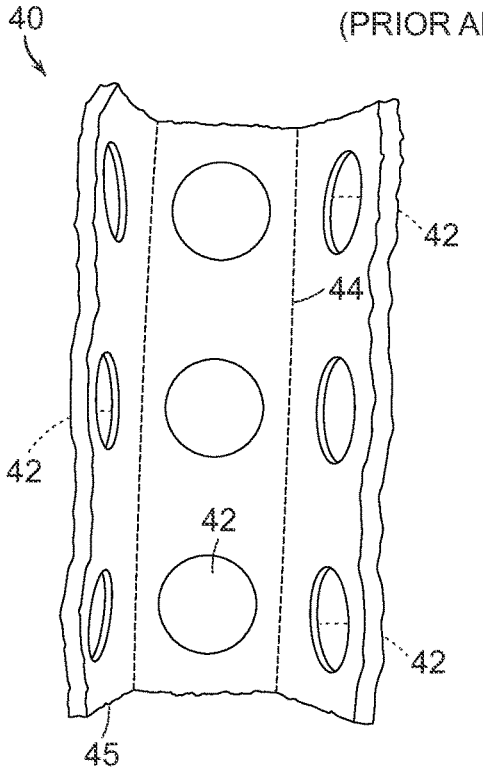
FIG. 2A (PRIOR ART)
FIG. 2A is a top view of the prior art foam tray shown in FIG. 2 showing the side walls folded along fold lines.
Figure 2B:
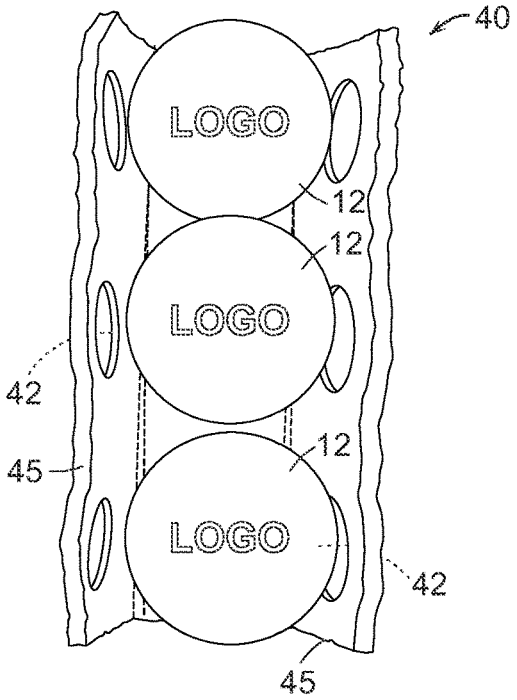
FIG. 2B (PRIOR ART)
FIG. 2B is a top view of the prior art foam tray shown in FIG. 2A showing the tray loaded with golf balls.

Referring to FIGS. 2-2B, in other instances, the golf balls (12) are placed by hand into a foam tray (40), which is then inserted into the sleeve (10). In these manual-loading operations, the balls (12) can be hand-oriented so the logo is visible on all of the balls, but there are several disadvantages with using a foam tray as shown in FIGS. 2-2B. For instance, the foam tray (40) is a very lightweight material with low mechanical strength; and it does not provide a very secure and stable platform to hold the golf balls (12). The foam tray normally is made from a single foam sheet (41) containing apertures (42) as shown in FIG. 2. This foam sheet (41) is bent across the fold lines (44) for form a rectangular ball carrier as shown in FIG. 2A; but the resulting foam tray (40) has poor durability. The edges (45) of the foam tray (40) can split and fray easily. Over time, the foam tray (40) can even break. Furthermore, the hand-loading of the balls (12) into the tray (40) is a time-consuming and cumbersome process. The balls (12) need to be carefully held and kept steady as they are being loaded. Even after the loading process has been completed, the balls (12) are not fully locked in place—they can rotate and shift their position in the foam tray (40). As shown in FIG. 2B, the golf balls have been loaded in the tray, but the balls are not secured. The trays of the present invention overcome the drawbacks with conventional foam trays as discussed further below.

Figure 3:
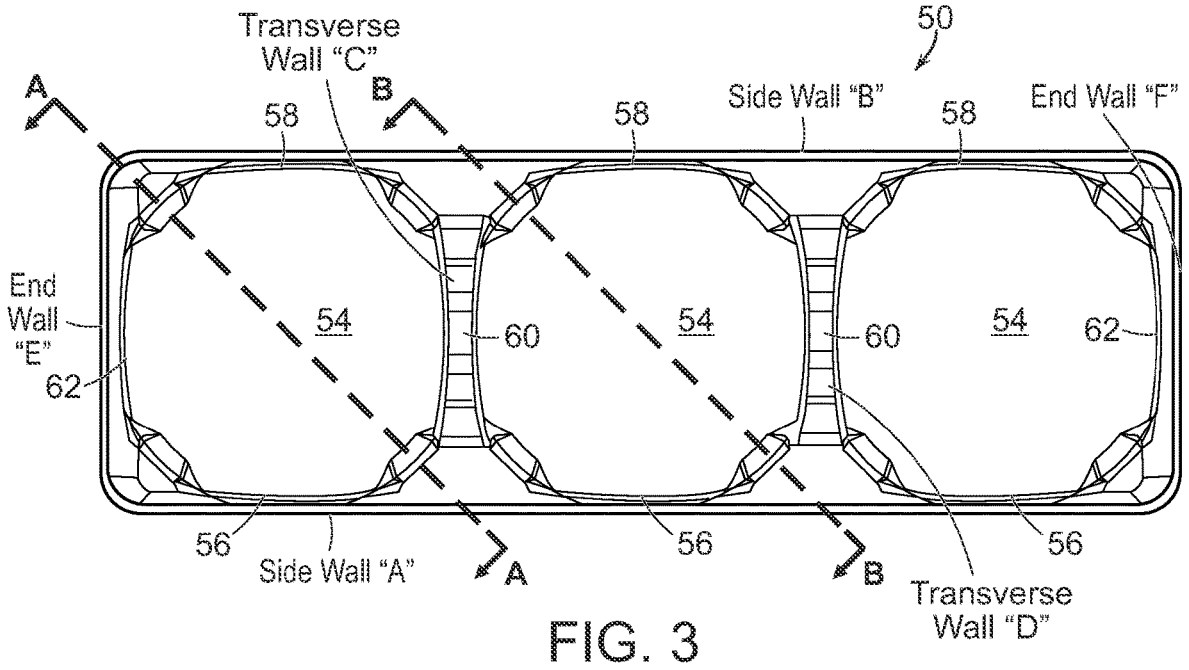
FIG. 3 is a top view of one embodiment of the golf ball tray of this invention showing the different compartments for the balls.

In FIGS. 3-8, different embodiments of the golf ball tray (50) of this invention are shown. Referring to FIG. 3, the tray (50) includes an elongated body member having three recessed cavities (54) for holding the golf balls (12). Each ball cavity has an arcuate inner surface (55) for holding the golf ball (12) in place and restricting rotation of the ball. These compartments (54) for holding the balls (12) are discussed further below. In general, the ball-holding tray (50) has two side walls (Sidewall "A" and Sidewall "B"), two transverse walls (Transverse Wall "C" and Transverse Wall "D"), and two end walls (End Wall "E" and End Wall "F"). The ball-holding trays of this invention offer several advantages over prior art golf ball packaging as discussed further below.

The ball-holding trays (50) shown in the Figures and primarily described herein are constructed for holding three (3) golf balls; however, it should be understood that the tray can hold any desired number of balls. For example, the tray can be constructed to hold a single ball, or two, three, four, or even a greater number of balls. As discussed further below, the tray is placed in a sleeve and can be packaged in a larger box. Normally, the tray contains three balls and the sleeve is constructed to hold a single tray. Then, the sleeve is placed in a box designed to hold two sleeves (a half-a-dozen box of golf balls) or four sleeves (a dozen box of golf balls).

The golf ball carrier tray (50) of this invention is preferably, a unitary, single-piece structure. The tray (50) can be molded using conventional molding processes including, for example, injection, blow, compression, extrusion, rotational, and thermoforming molding processes. A wide variety of resins including, for example, (meth)acrylic resins such polymethyl methacrylate (PMMA), polyurethane (PU), polyvinyl chloride (PVC), polycarbonate (PC), acrylonitrile/butadiene/styrene copolymer (ABS), polyolefins such as polyethylene (PE) and polypropylene (PP), polyesters such as polyethylene terephthalate (PET) and polyethylene naphthalate (PEN), and copolymers such as ethylene/acrylic acid copolymer, ethylene/ethyl acrylate copolymer, and ethylene/vinyl acetate copolymer, or mixtures thereof can be used to form the tray (50). In one preferred embodiment, polyethylene terephthalate (PET) is used to form the tray (50).

Tray Structure Prior to Loading Balls

Figure 3A:
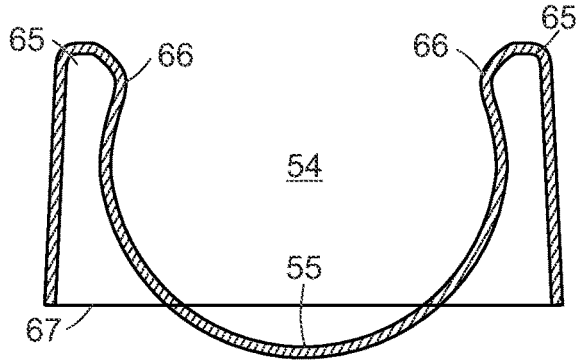
FIG. 3A is a cross-sectional view of a compartment of the golf ball tray of this invention along Line A-A in FIG. 3.
Figure 3B:
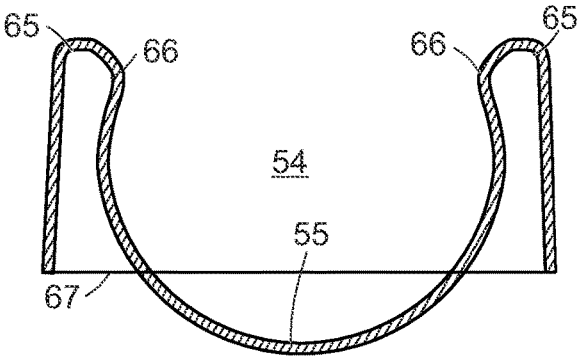
FIG. 3B is a cross-sectional view of a compartment of the golf ball tray of this invention along Line B-B in FIG. 3.
Figure 4:
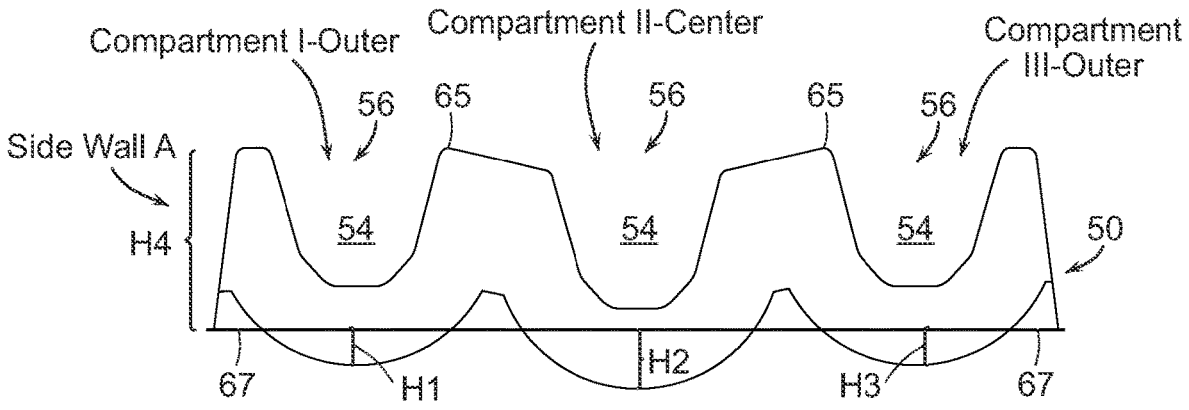
FIG. 4 is a side view of one embodiment of the golf ball tray of this invention prior to inserting the balls into the compartments of the tray.
Figure 5:
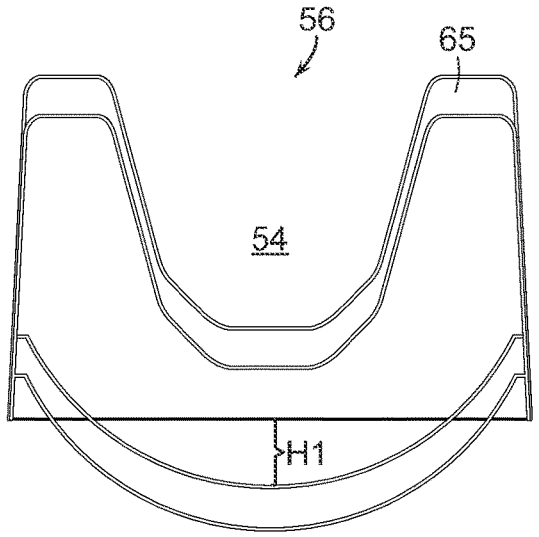
FIG. 5 is a close-up view of one compartment of the golf ball tray of this invention as shown in FIG. 4.

Referring to FIGS. 3-5, a tray (50) that does not contain any golf balls (12) is shown. The tray (50) is designed to hold three balls, and Sidewalls A and B of the tray each have three cut-out notches (56, 58) that are generally spaced-apart evenly. The tray (50) also includes two transverse walls (Transverse Wall "C" and Transverse Wall "D"), and two end walls (End Wall "E" and End Wall "F"). As shown in FIG. 3, Transverse Walls C and D each have a cut-out notch (60), and End Walls E and F each have a cut-out notch (62). Thus, the tray (50) has an egg-carton like structure. In FIGS. 3A and 3B, cross-sectional views of two of the compartments (54) for holding the golf balls (12) are shown. In FIG. 4, a side view of the tray (50) (Sidewall A) is shown. In FIG. 5, a close-up view of a Sidewall A notch (56) is shown. The notch (56) has a U-Shaped (or truncated V) shape with extending arm segments (65) having chamfered upper edges (66) as discussed further below. The other notches (58, 60, and 62) in the tray (50) have similar structures.

Thus, there are three "compartments" or "pockets" (54) formed in the tray (50), wherein each compartment is defined by a cavity and four surrounding notches (56, 58, 60, and 62). More particularly, the first ball compartment (Compartment I—Outer) has a notch in Sidewall A (56) and Sidewall B (58), a notch in Transverse Wall C (60), and a notch in End Wall E (62). The second ball compartment (Compartment II—Center) also has notches in Sidewall A (56) and Sidewall B (58), and notches in Transverse Wall C and Transverse Wall D (60). The third ball compartment (Compartment III—Outer) has a notch in Sidewall A (56) and Sidewall B (58), a notch in Transverse Wall D (60), and a notch in End Wall E (62).

As discussed above, the compartments (54) have arm segments (65) for holding the golf ball (12) in place. The arm segments (65) hold and lock the balls (12) in the compartments (54). The upper edges (66) of the arm segments (65) are chamfered. In this way, the arm segments (65) provide a type of entry ramp so that the balls can slide easily into a compartment (54) during loading. Referring back to FIG. 5, a close-up view of the compartment (54) having the U-shaped notch in Sidewall A is shown. As illustrated in FIG. 5, the compartment (54) has a recessed cavity with an arcuate inner surface (55) that extends below the base portion (67) of Sidewall A.

In FIGS. 3-5, the tray (50) is shown in a state prior to loading the golf balls (12) into the tray. As shown in FIG. 4, the tray has a wave-like structure, wherein the three ball compartments (54) have different heights. The tray has a wave-like structure so that the height of the ball compartments is different. Ball 1 is loaded into Compartment I-Outer; Ball 2 will be loaded into Compartment II-Center; and Ball 3 will be loaded into Compartment III-Outer.

In one preferred embodiment, the lower portion of Compartment I-Outer sits slightly below the base of Sidewall A. For example, the bottom curved surface of Compartment I-Outer can rest at about 0.10 to about 0.40 inches below the base of Sidewall A (H1-Outer). In one preferred embodiment, the distance from the base of Sidewall A to the bottom surface of Compartment I is 0.2167 inches (H1-Outer). The lower portion of Compartment II-Center also sits slightly below the base of Sidewall A. For example, the bottom curved surface of Compartment II-Center can rest at about 0.20 to about 0.50 inches below the base of Sidewall A (H1-Center). In one preferred embodiment, the distance from the base of Sidewall A to the bottom surface of Compartment II is 0.3414 inches (H2-Center). Lastly, the bottom curved surface of Compartment III-Outer can rest at about 0.10 to about 0.40 inches below the base of Sidewall A (H3-Outer). In one preferred embodiment, the distance from the base of Sidewall A to the bottom surface of Compartment III-Outer is 0.2167 inches (H1-Outer). Thus, the tray (50) has a non-level configuration prior to loading the balls.

Tray Structure After Loading Balls

Figure 6:
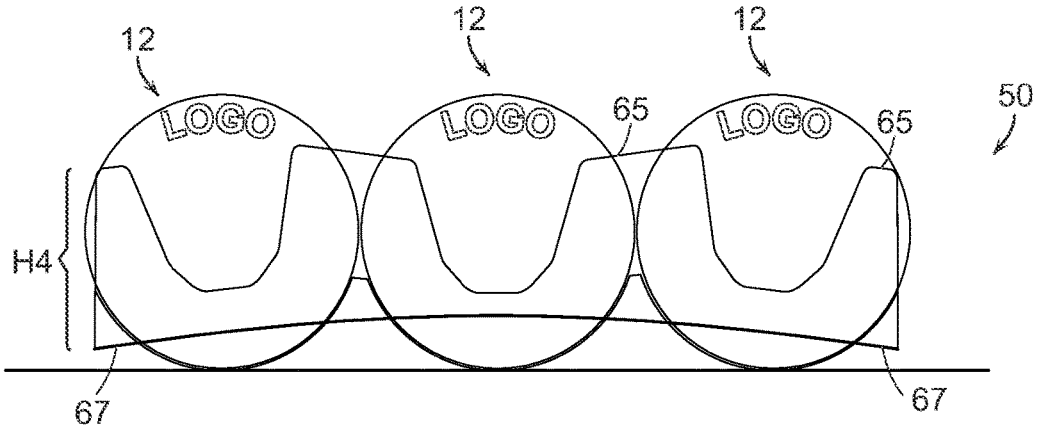
FIG. 6 is a side view of one embodiment of the golf ball tray of this invention after inserting the balls into the compartments of tray.

Turning to FIG. 6, in the loading operation, the golf balls (12) are pressed into the compartments (54) and snapped into place. The Sidewalls A and B, Transverse Walls C and D, and End Walls E and F have some flexibility so that the walls slightly flex apart when a ball (12) is pressed into a particular compartment (54). The Sidewalls A and B, Transverse Walls C and D, and End Walls E and F then return to their original shape once the ball is inserted. These steps are repeated for inserting each ball (12) into a separate compartment (54).

As discussed above, the tray (50) is made of a material that that will deflect when the ball is inserted. Thus, when a person pushes the golf balls (12) into the compartments (54), this forces the tray (50) to deflect outwardly and the bases of the sidewalls to form arcs. In FIG. 5, the base portion (67) of Sidewall A is shown in a flexed, curved position. For example, the radius of curvature of the base (67) of Sidewall A can be in the range of about 0.05 to about 2.5 inches. In one preferred embodiment, the radius of curvature is about 0.11 inches. That is, Sidewall A has a curved scallop shell-like shape as opposed to a flatter shape. In another example, if the radius of curvature of Sidewall A is 0.51 inches, it would mean that Sidewall A was flexed and curved to a greater extent—that is, it would have a more carved-out structure.

As shown in FIG. 6, after the golf balls (12) have been loaded into the tray (50), the balls are locked into place in the compartments (54) and the heights of the balls are substantially the same. The balls (12) have a substantially level height in the tray (50). The snap-in features of the tray (50) help hold the balls in place and restrict rotation and displacement of the balls (12). As illustrated in FIG. 6, the lower base of the tray (50) is curved and this structure makes it easier to load the tray in the sleeve box as discussed further below.

In FIG. 6, each of the golf balls (12) is shown with the logo facing in an upwardly direction. The tray (50) will be inserted into a sleeve box (not shown) so that these upper portions of the balls (12) will rest against a transparent window in the sleeve. In this way, the logos on the balls will be clearly visible to a person looking through the window of the sleeve.

Figure 7:
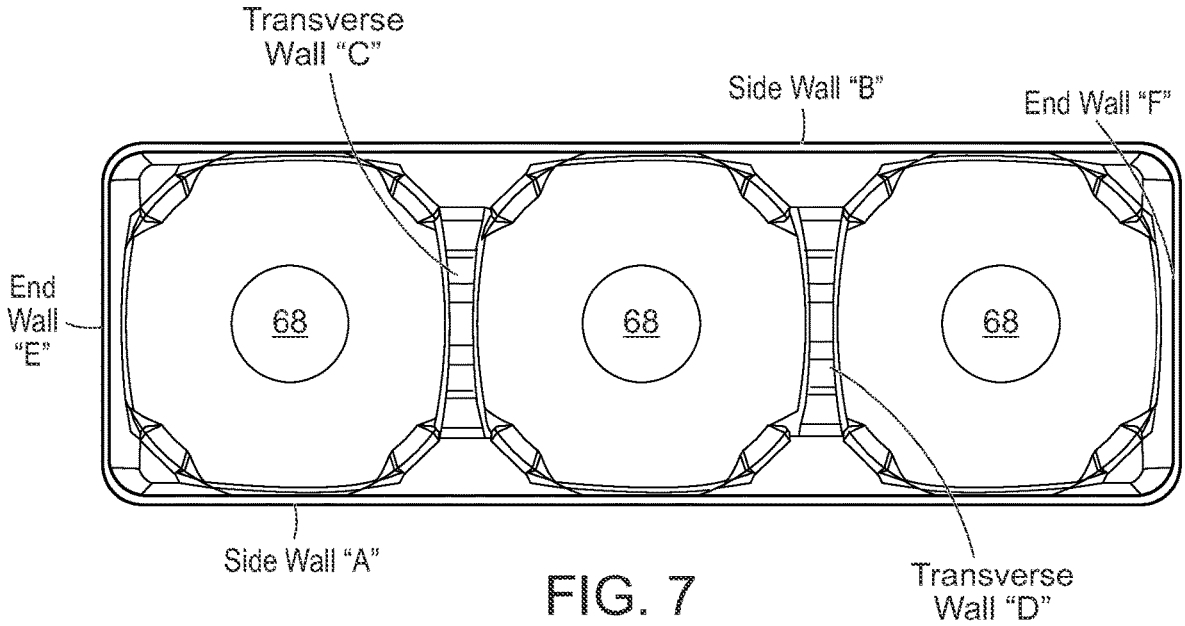
FIG. 7 is a top view of a second embodiment of the golf ball tray of this invention showing the different compartments for the balls.

Referring to FIG. 7, in another embodiment, the orientation of the golf balls (12) in the tray (50) is reversed so the logos are facing in a downwardly direction. In this example, each of the compartments can have an aperture (68) so that the logo on the lower portion of the ball (12) is clearly visible. Here, the tray (50) will be inserted into a sleeve box (not shown) so that these lower portions of the balls (12) will rest against the window in the sleeve. In this way, the logos on the balls will be visible through the window.

Each compartment (54) is sized to hold a single golf ball (12). As discussed further below, the size (dimeter) of each compartment (54) is slightly less than the diameter of the spherical ball (12) and this allows the ball to be snap-fitted into place in the compartments. As the balls (12) are being pressed into the compartments (54), a slight clicking noise can be heard. The balls (12) are wedged into the compartments (54) and locked in place. In one method of this invention, the golf balls (12) are placed by hand into the compartments (54) of the tray (50). The balls (12) are locked in place. Then, the loaded tray (50) is inserted into the sleeve (10).

To remove a ball (12) form a compartment (54) in the tray (50), a person can grasp the tray (50) with one hand and then grasp the ball between his/her thumb and index finger of the other hand and pull upwardly. More particularly, to remove the first ball (12) from the tray (50), the person places their thumb into the first notch (56) of Sidewall "A" and grasps one portion of the ball. The person then places their index finger in the opposing first notch (58) of Sidewall "B" and grasps the opposing portion of the ball. The person then pulls the ball (12) out of the compartment (54). To remove the second ball, the person places their thumb into the second notch (56) of Sidewall "A" and index finger in the opposing second notch (58) of Sidewall "B." This process is repeated for removing the third ball (12) and any other balls contained within the tray (50).

The dimensions of the tray (50) can vary based on the sizes of the golf balls (12) that will be loaded in the tray. These compartments (54) preferably define a space that is slightly smaller than the size of the spherical golf ball (12) so that the ball fits tightly in the compartment. The ball (12) is snap-fitted into the slightly smaller compartment (54).

Golf balls are available in many different sizes. For example, the Royal and Ancient Golf Club of St. Andrews, Scotland (R&A Rules Limited) and United States Golf Association (USGA) have established standards for the weight, size, and other properties of golf balls. The R&A and USGA have established a maximum weight of 1.62 ounces (45.93 grams) and a minimum size (diameter) of 1.68 inches. Thus, golf balls need to have a diameter of at least 1.68 inches in order to meet the R&A and USGA rules. Most manufacturers want to produce golf balls that meet R&A and USGA standards. Thus, most golf balls have a size in the range of about 1.68 to about 1.80 inches and are referred to as "conforming" golf balls. However, there are some "non-conforming" golf balls having a size of less than about 1.68 inches in the marketplace. For example, there are some non-conforming golf balls having a size of about 1.57 to about 1.67 inches. Over-sized golf balls having relatively large diameters also are known. For example, golf balls having a diameter size greater than 2.0 inches can be made.

Packaging of Tray in Sleeve

Figure 8:
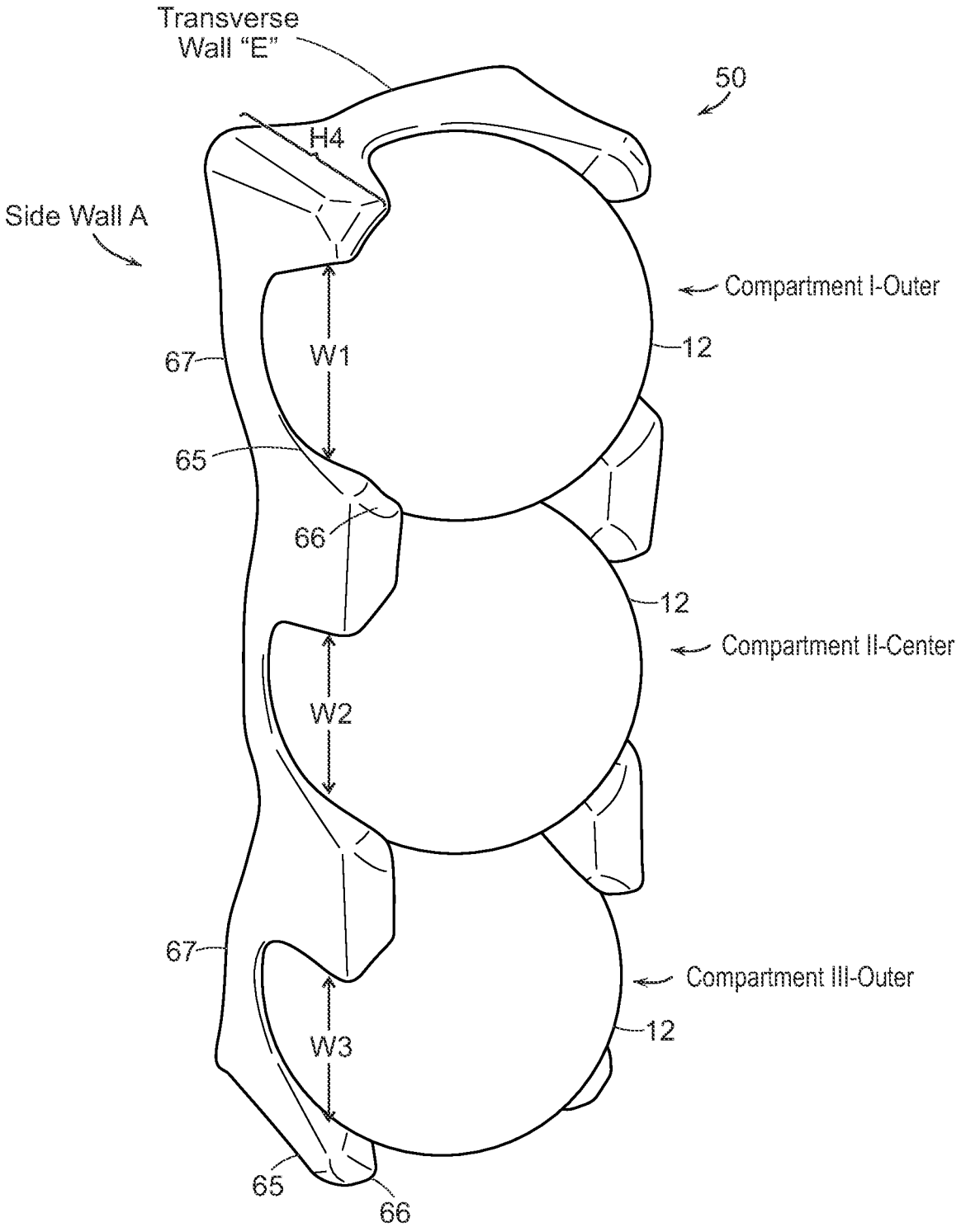
FIG. 8 is a perspective view of one embodiment of the golf ball tray of this invention showing the balls loaded in the different compartments of the tray.

Turning to FIG. 8, the tray has a generally rectangular shape and the lengths of Sidewalls A and B are greater than widths of the End Walls E and F. The lengths of Sidewalls A and B are generally in the range of about 2 to about 6 inches, preferably about 4.5 to about 5.5 inches. In one preferred embodiment, Sidewall A has a length of about 5.04 inches, and Sidewall B has a length of 4.97 inches. Meanwhile, the lengths of End Walls E and F are generally in the range of about 1 to about 2 inches. In one preferred embodiment, End Wall E has a width of about 1.68 inches and End Wall F has a width of about 1.61 inches.

As discussed above, the compartments (54) preferably define a space that is smaller than the size of the golf ball (12). In this way, the ball (12) can be wedged into the compartment (54) and is secured tightly. The locked-in ball (12) is prevented from rotating and being displaced. The ball (12) is snap-fitted into the compartments (54). The size (width) of the compartments (54) is normally in the range of about 1 to about 2 inches, preferably about 1.3 to about 1.7 inches. As shown in FIG. 8, in one preferred embodiment, the end compartments (Compartment I—Outer) and (Compartment III—Outer) have a width of 1.5402 inches. In this embodiment, the arm segments (65) have a height of about 1.0718 inches. Turning to the central compartment (Compartment II—Center), this compartment has a width of 1.5203 inches and the arm segments having a height of 0.9472 inches. In this embodiment, the sizes of the compartments (54) satisfy the relationship of Size of Compartment I—Outer>Size of Compartment II—Center<Size of Compartment III—Outer. Preferably, the sizes of Compartments I and III are substantially the same.

Referring back to FIG. 4, the tray (50) is shown prior to the balls (12) being loaded into the sleeve (70). The tray (50) has a wave-like structure so that the height of the ball compartments (54) is different. Each compartment (54) is sized to hold a single ball (12). As discussed above, the tray (50) is made of a plastic material that that will slightly deflect when the balls are inserted into the compartments (54). As shown in FIGS. 6 and 8, after the balls (12) have been loaded into the tray (50), the balls are locked into place in the compartments (54) and the height of the balls (12) is substantially the same. The arm segments (65) keep the balls (66) secured and locked in place. The tray (5) is now ready to be loaded into a sleeve.

Figure 9:
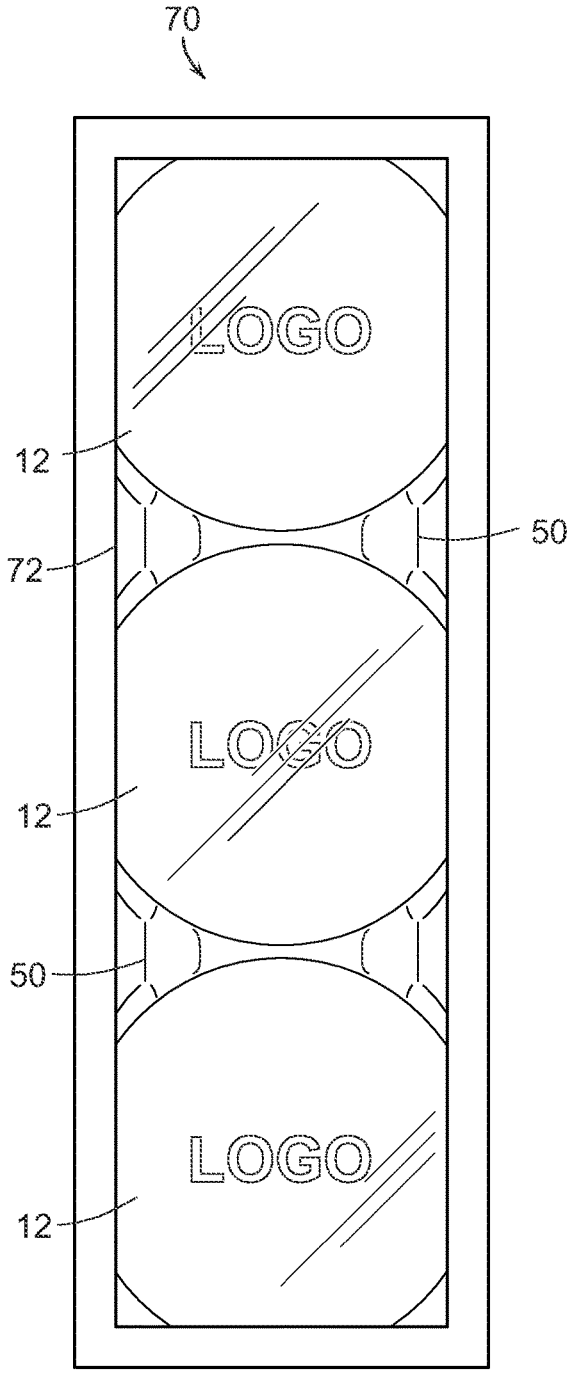
FIG. 9 is a front view of one embodiment of a sleeve containing the golf ball tray of this invention, wherein multiple golf balls are visible through the rectangular-shaped transparent window of the sleeve.
Figure 9A:
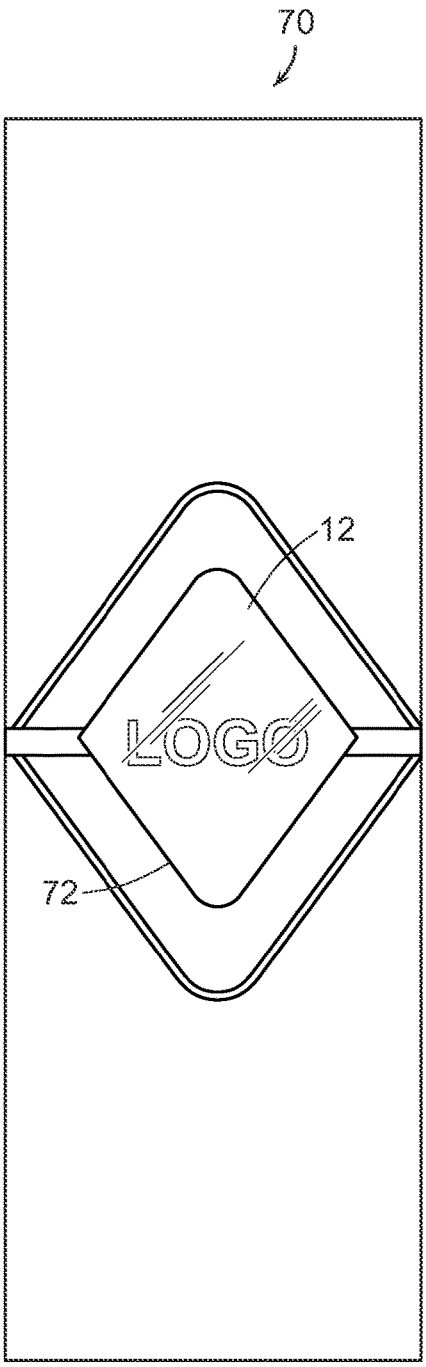
FIG. 9A is a front view of a second embodiment of a sleeve containing the golf ball tray of this invention, wherein a single golf ball is visible through the diamond-shaped transparent window of the sleeve.

Referring to FIGS. 9 and 9A, the balls are preferably loaded into compartments of the tray and precisely aligned so that the desired portion of the ball (normally containing the logo) in the tray is adjacent to the desired sidewall of the sleeve (70) (normally containing the window (72)). In FIG. 9, the sleeve (70) has a single, rectangular-shaped window (72), and the three balls (12) are positioned in the tray (50) so that the logo on each ball can be clearly seen. In FIG. 9, some parts of the tray (50) are also visible through the window (72). Turning to FIG. 9A, in this embodiment, the sleeve (70) has a single, diamond-shaped window (72), and the balls (12) are positioned in the tray (50) so that the logo on one ball can be clearly seen. The other two balls are oriented in a similar manner in the tray (50) for the sleeve (70) shown in FIG. 9A. However, the logos on these balls are not visible, because the sleeve box (70) in FIG. 9A only has one diamond-shaped window (72).

Figure 10:
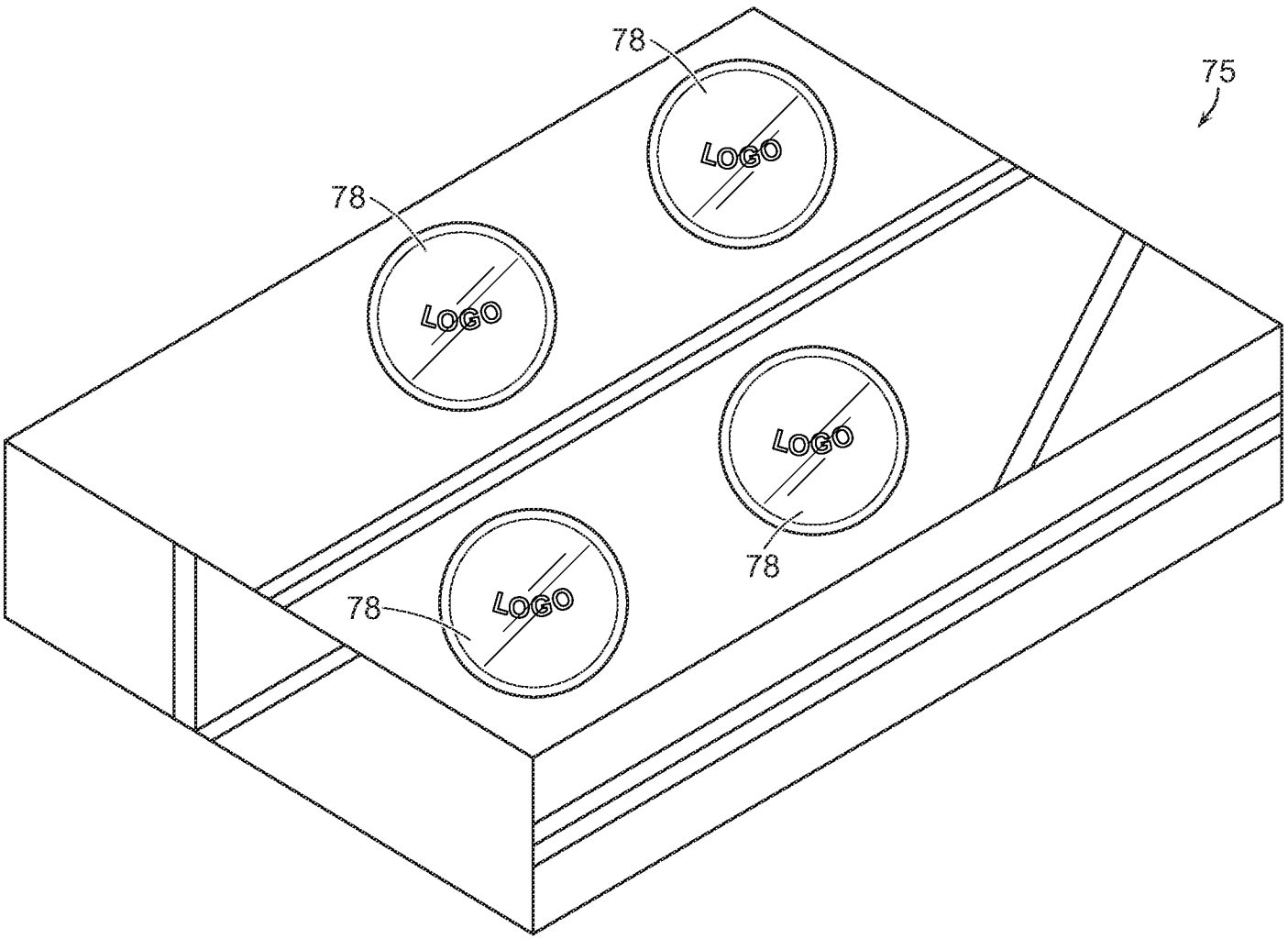
FIG. 10 is a perspective view of one embodiment of a packaging box containing multiple sleeves each containing the golf ball tray of this invention, wherein a single golf ball is visible through the transparent window of each sleeve and each transparent window of the packaging box.

Next, the sleeve (70) with the loaded balls (12) can be packaged in a larger packaging box. Referring to FIG. 10, in one embodiment, the sleeves are loaded in a packaging box (75) designed to hold four sleeves (a dozen box of golf balls). In another embodiment, the sleeve (70) can be loaded in a packaging box (75) designed to hold two sleeves (a half-dozen box of golf balls). In FIG. 10, the packaging box (75) is shown having four windows (78) located on its removable cover. As discussed above, the balls (12) are placed in the compartments (54) of the tray (50) so that the logos are aligned with the window (72) in the sleeve (70). Then, the sleeves (70) are placed in the packaging box (75) so that the windows (72) of the sleeve (70) are aligned with the windows (78) of the larger packaging box (75). In FIG. 10, there are four windows (78) located on the removable cover of the box (75), but this is only one example of a suitable packaging box and should not be considered as limiting. A wide variety of packaging boxes (75) with different window placements, different amounts of windows, and different shaped windows can be used in accordance with this invention. The packaging box (75) can be of any suitable size. For example, the windows (78) can be located on the top portion, bottom portion, or any side portion of the box (75). Also, the box (75) can contain a single window (78) or multiple windows (78) arranged in any desired pattern. The windows (78) can be of any suitable shape including, for example, circular, oval, triangular, rectangular, square, star, diamond, pyramid, arrow, conical, pentagonal, hexagonal, heptagonal, and octagonal, and the like structures. The spacing between the windows (78) in the box (75) are such that each window (78) is aligned with the logo portion of a given ball (12). The sleeve (70) is placed into the box (75) so that the window (72) of the sleeve registers with the window (78) of the box. In this way, the logo on the ball (12) is clearly visible to a person looking at the packaging box (75). This precise alignment of the golf ball (12) in the tray compartment (54) with the window in the sleeve (70) and the window in the packaging box (75) provides a unique display and showing of the ball in box (75).

These golf ball boxes are then shipped to individual customers or a retail operation for sale. Some retail facilities are referred to "on-course" shops such as golf shops located at public, private, and resort golf courses. Other retail facilities are referred to as "off-course" shops such as retails stores located in shopping malls. The golf ball packaging of this invention is creative and unique—it provides a distinctive way to ship the product and for an individual customer or retail operation to display the product. In traditional golf ball packaging, the balls can knock into each other when lifting, carrying, and placing the packages down. This handling of conventional golf ball packages can cause nicks and scratches on the outer surfaces of the balls as they are jostled about. The golf ball packages, sleeves, and trays of this invention overcome these problems. As discussed above, in the balls (12) are locked into place in the compartments (54) of the trays (50) of this invention. As discussed above, the snap-in features of the tray (50) help hold the balls in place and restrict rotation and displacement of the balls (12) during shipping and handling.

As discussed above, many individual golfers like to personally customize their golf balls with a special name, symbol, initials, letters, numbers, geometric shapes, and the like. These golfers are interested in aesthetically-pleasing packages to show their customized balls. The golf ball packages of this invention can be attractively displayed in clubhouses, offices, homes, and other places.

Meanwhile, retail operations are constantly looking for new merchandising and advertising tools. The golf ball manufacturers and retail professionals can use the golf ball packaging of this invention to display the golf balls in distinctive ways. For example, golf ball manufacturers can make their brands and brand names "jump-out" to potential customers. This brand advertising in the boxes can help promote sales. In other examples, retail operations can display the packages of this invention on shelves in attractive ways to entice customers to purchase the golf balls.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention.

It also should be understood the terms, "first", "second", "third", "top", "bottom", "upper", "lower", "downward", "right", "left", "middle" "outer", "center" "anterior", "posterior", and the like are arbitrary terms used to refer to one position of an element based on one perspective and should not be construed as limiting the scope of the invention.

It is understood that the golf ball, tray, sleeve, and packaging box materials and constructions described and illustrated herein represent only some embodiments of the invention. It is appreciated by those skilled in the art that various changes and additions can be made to materials and constructions without departing from the spirit and scope of this invention. It is intended that all such embodiments be covered by the appended claims.

We claim:

1. A golf ball tray, comprising:

an elongated body member comprising a first sidewall having at least three notches and an opposing second sidewall having at least three notches, the elongated body member having a base portion containing at least three recessed cavities;

a first end wall and a second end wall, the first and second end walls being joined to the first and second sidewalls, wherein each of the first and second end walls has a notch;

a first transverse wall and a second transverse wall, the first and second transverse walls extending from the first sidewall to the second sidewall, wherein each of the first and second transverse walls has a notch;

a first ball compartment defined by the first cavity and a first notch in the first sidewall, a first notch in the second sidewall, a notch in the first end wall, and a notch in the first transverse wall;

a second ball compartment defined by the second cavity and a second notch in the first sidewall, a second notch in the second sidewall, the notch in the first transverse wall, and a notch in the second transverse wall; and a third ball compartment defined by the third cavity and a third notch in the first sidewall, a third notch in the second sidewall, a notch in the second end wall, and the notch in the second transverse wall, wherein each of the first, second, and third ball compartments has an arcuate inner surface defined between at least one pair of arm segments, wherein an end portion of the at least one pair of arm segments projects inwards towards a center of the first, second, and third ball compartments, and wherein the first, second, and third ball compartments have the following relationship: width of first ball compartment>width of second ball compartment<width of third ball compartment.

2. The golf ball tray of claim 1, wherein the tray is made of polyester.

3. The golf ball tray of claim 1, wherein each of the first and second sidewalls has a length in the range of about 3 inches to about 6 inches and each of the first and second end walls has a length in the range of about 1 inch to about 2 inches.

4. The golf ball tray of claim 1, wherein each of the first, second, and third ball compartments has a width in the range of about 1 inch to about 2 inches.

5. The golf ball tray of claim 1, wherein the width of first ball compartment is equal to the width of the third ball compartment.

6. The golf ball tray of claim 1, wherein each of the first, second, and third ball compartments has four arm segments surrounding the recessed cavity for holding the balls in the respective first, second, and third ball compartments.

7. The golf ball tray of claim 6, wherein the four arm segments have chamfered edges.

8. The golf ball tray of claim 1, wherein the base portion of the tray has a curved structure after the balls have been loaded into the first, second, and third ball compartments of the tray.

9. The golf ball tray of claim 1, wherein the arcuate inner surface has a constantly curved, uninterrupted profile between respective ends of the at least one pair of arm segments.

10. A package assembly for golf balls, comprising:

a first elongated body member having a first end and an opposing second end and four sides extending from the first end to the second end, the first elongated body member defining a hollow interior region having a square cross-sectional shape for receiving a golf ball tray containing golf balls, the first elongated body member having at least one transparent window so that at least one golf ball in the tray is visible;

wherein the tray comprises:

a second elongated body member comprising a first sidewall having at least three notches and an opposing second sidewall having at least three notches, the second elongated body member having a base portion containing at least three recessed cavities;

a first end wall and a second end wall, the first and second end walls being joined to the first and second side walls, wherein each of the first and second end walls has a notch;

a first transverse wall and a second transverse wall, the first and second transverse walls extending from the first sidewall to the second sidewall, wherein each of the first and second transverse walls has a notch;

a first ball compartment defined by the first cavity and a first notch in the first sidewall, a first notch in the second sidewall, a notch in the first end wall, and a notch in the first transverse wall;

a second ball compartment defined by the second cavity and a second notch in the first sidewall, a second notch in the second sidewall, the notch in the first transverse wall, and a notch in the second transverse wall; and a third ball compartment defined by the third cavity and a third notch in the first sidewall, a third notch in the second sidewall, a notch in the second end wall, and the notch in the second transverse wall;

wherein the first, second, and third ball compartments have the following relationship: width of first ball compartment>width of second ball compartment<width of third ball compartment.

11. The package assembly of claim 10, wherein the at least one transparent window of the first elongated body member comprises a plurality of transparent windows, the plurality of transparent windows being disposed such that multiple golf balls in the tray are visible.

12. The package assembly of claim 11, wherein the plurality of transparent windows have circular or square shapes.

13. The package assembly of claim 10, wherein the first elongated body member is made of cardboard.

14. A package assembly for golf balls, comprising:

a first elongated body member having four chamber walls, the four chamber walls being joined to each other and defining an interior chamber, the chamber being covered by a removable lid so that the chamber can be exposed by removing the lid and covered by closing the lid;

a second elongated body member having a first end and an opposing second end and four sides extending from the first end to the second end, the second elongated body member defining a hollow interior region having a square cross-sectional shape for receiving a golf ball tray containing golf balls;

the first and second elongated body members each having at least one transparent window so that the transparent window of the first elongated body registers with the transparent window of the second elongated body so that at least one golf ball in the tray is visible;

wherein the tray comprises:

a third elongated body member comprising a first sidewall having at least three notches and an opposing second sidewall having at least three notches, the third elongated body member having a base portion containing at least three recessed cavities;

a first end wall and a second end wall, the first and second end walls being joined to the first and second side walls, wherein each of the first and second end walls has a notch;

a first transverse wall and a second transverse wall, the first and second transverse walls extending from the first sidewall to the second sidewall, wherein each of the first and second transverse walls has a notch;

a first ball compartment defined by the first cavity and a first notch in the first sidewall, a first notch in the second sidewall, a notch in the first end wall, and a notch in the first transverse wall;

a second ball compartment defined by the second cavity and a second notch in the first sidewall, a second notch in the second sidewall, the notch in the first transverse wall, and a notch in the second transverse wall; and a third ball compartment defined by the third cavity and a third notch in the first sidewall, a third notch in the second sidewall, a notch in the second end wall, and the notch in the second transverse wall;

wherein the first, second, and third ball compartments have the following relationship: width of first ball compartment>width of second ball compartment<width of third ball compartment.

15. The package assembly of claim 14, wherein the first and second elongated body members have multiple transparent windows, the windows being registered with each other so that multiple golf balls in the tray are visible.

16. The package assembly of claim 15, wherein the transparent windows have circular or square shapes.

17. The package assembly of claim 14, wherein the first and second elongated body members are each made of cardboard.

* * * * *